US005187902A

United States Patent [19]

Bakanowsky, III

[11] Patent Number: 5,187,902

[45] Date of Patent: *Feb. 23, 1993

[54] CLEANING CARTRIDGE FOR COMPUTER AND VIDEO GAMES

[75] Inventor: Louis J. Bakanowsky, III, Fitchburg, Mass.

[73] Assignee: Curtis Manufacturing Company, Inc., Jaffrey, N.H.

[ * ] Notice: The portion of the term of this patent subsequent to Sept. 8, 2008, has been disclaimed.

[21] Appl. No.: 900,417

[22] Filed: Jun. 18, 1992

Related U.S. Application Data

[63] Continuation-in-part of Ser. No. 721,163, Jun. 26, 1991, Pat. No. 5,144,775.

[51] Int. Cl.[5] ..... B24B 29/06

[52] U.S. Cl. ..... 51/205 R; 15/210 R; 51/205 WG

[58] Field of Search ..... 51/57, 281 R, 59 R, 51/358, 381, 392, 393, 205 R, 205 WG; 15/104.92, 104.93, 104.94, 210 R, 118; 134/6, 8, 22.1

[56] References Cited

U.S. PATENT DOCUMENTS

| | | | |
|---|---|---|---|
| 3,807,010 | 4/1974 | Semrad | 15/210 R |
| 3,956,789 | 5/1976 | Shultz | 51/59 R |
| 4,428,092 | 1/1984 | Lipari | 15/246 |
| 4,951,425 | 8/1990 | Naghi | 15/210 R |
| 4,993,100 | 2/1991 | Halboth | 15/210 R |
| 5,025,526 | 6/1991 | Ichitsubo | 15/210 R |

*Primary Examiner*—Bruce M. Kisliuk
*Assistant Examiner*—Jack Lavinder
*Attorney, Agent, or Firm*—Richard P. Crowley

[57] ABSTRACT

A cleaning cartridge device for cleaning the electrical contacts within a computer video game receptacle. The device includes a housing for insertion into the cartridge receptacle, a board 56 with cleaning material at the one end within the housing, the board having a handle end 76 extending from one end of the housing, and the board slidably movable by the use of the handle end 76 between defined stop positions of a cleaning position for the electrical contacts with the cleaning material in contact with the electrical contacts and a non-cleaning position spaced apart from the electrical contacts.

10 Claims, 2 Drawing Sheets

CLEANING CARTRIDGE FOR COMPUTER AND VIDEO GAMES

REFERENCE TO PRIOR APPLICATION

This application is a continuation-in-part of U.S. patent application Ser. No. 07/721,163, filed Jun. 26, 1991, now U.S. Pat. No. 5,144,775, entitled CLEANING CARTRIDGE AND METHOD FOR COMPUTER AND VIDEO GAMES, hereby incorporated by reference in its entirety.

The parent application is directed toward a cleaning cartridge for cleaning electrical contacts of the connector block within a computer or video game cartridge receptacle. The cleaning cartridge comprises a housing configured to be inserted and to be fitted within said cartridge receptacle and typically comprises two molded plastic half sections which are secured together to form the housing. The cartridge also includes a board means, such as a flat, planar board means, having a one end and the other end with the board means located for slidable movement within the housing and wherein the housing encloses a portion of the board means. One end of the planar board means extends outwardly from an elongated slot at one end of the housing and is adapted to be grasped by an operator so that the board means may be moved between a cleaning and a non-cleaning position. The other end is adapted to fit on the opposite side of a recess within the housing, the recess placed around the electrical contacts, and the other end having at least one surface, and typically, two flat surfaces and an edge containing thereon a cleaning material, such as an abrasive-type cleaning material, adapted to be placed in contact with the electrical contacts so that on repeated movement of the planar board means, the electrical contacts are abrasively cleaned. Within the housing are grooves and tracks and supporting ribs so as to provide for a basis for the guided, slidable movement of the planar board between an extended position wherein the other end of the planar board is in a cleaning position in contact or adjacent the electrical contacts in a non-cleaning position wherein the board is retracted and still within the housing and out of direct contact with the electrical contacts. The cleaning cartridge of the parent application permits the replacement of a section of the planar board means or of the board means itself by an operator when the cleaning section has been rendered partially or wholly ineffective.

BACKGROUND OF THE INVENTION

Computers, such as personal computers, and a wide variety of video game systems, such as the Nintendo ® game system and the hand-held, portable Game Boy ® systems (Nintendo and Game Boy are registered trademarks of Nintendo of America, Inc.) are adapted to receive computer and video game cartridges within a program cartridge receptacle. Generally, the cartridge comprises a printed circuit board enclosed within a housing, the housing adapted to fit within the cartridge receptacle. For example, in the Nintendo ® video game system, typically the game cartridge is inserted within the cartridge receptacle and then pushed downwardly by the user to lock the cartridge in place, and then the cartridge after use is released by downward pressure to spring into an upward position. In the portable Game Boy ®, the game cartridge may merely just be inserted within the cartridge receptacle. The printed circuit boards of the cartridges employed are electrically connected to the electronic system of a computer or video game system when the cartridge is inserted in the cartridge receptacle The electrical contacts within the computer or video game systems often acquire dust, dirt, oil and oxidation and other debris detrimental to the efficient operation of the electrical contacts from the frequent use of the cartridges into the cartridge receptacle. Such debris adversely effects the electrical surface performance of the computer or video game system, so that the efficient and frequent cleaning of the electrical contacts is a desirable procedure.

Generally, the employment of alcohol or other solvents via swab-type methods or by the employment of hand-held cleaning, polishing or burnishing tools is awkward and not easily accomplished by users.

A computer and video game cleaning cartridge has been disclosed in U.S. Pat. No. 4,951,425, issued Aug. 28, 1990 in which a cleaning cartridge is inserted into a receptacle and burnishing material at one end of a planar board provides for the cleaning of the electrical contacts of the connector block when the cartridge is inserted in place. Such a cleaning cartridge requires replacement of the entire cartridge when the burnishing material on the board has been used or deteriorated, and further, such cleaning cartridge immediately places the burnishing materials into a cleaning position upon insertion of the cartridge into the cartridge receptacle.

It is desirable to provide for a new, inexpensive, flexible cleaning cartridge and method in which the cleaning cartridge in the cartridge receptacle may be placed in a non-cleaning or cleaning position by the user and by which the boards containing the polishing, cleaning or burnishing materials may be easily and readily replaced by the user without replacement of the entire cartridge and to provide other advantages.

SUMMARY OF THE INVENTION

The present invention is directed to a cleaning cartridge for computer and video games and to a method of cleaning electrical contacts of a connector block within the cartridge receptacle of a computer or video game system.

In a further embodiment of the invention, there has been provided a cleaning cartridge for cleaning the electrical contacts within a computer or video game cartridge receptacle and wherein the cleaning cartridge comprises a housing typically composed of two plastic molded sections, typically half, sections, wherein in one embodiment the half sections are the same or similar in structure, but wherein the housing has at one end an elongated opening, a recessed slot within the opening, the elongated opening adapted to be inserted within the cartridge receptacle and an opposite end containing an elongated slot wherein the half sections of the housing are adapted to be snapped together or pinched together in a releasable manner so that the board means within the housing may be easily inserted or replaced by an operator.

At least one of these housing sections, and typically both sections, include a pair of raised rib sections generally parallel and spaced apart generally extending between the elongated slot and recessed opening of the housing. At one end of the slot on the recessed opening portion of the housing the raised ribs are of less height than the remaining portion of the raised ribs to define a short space which provides for and defines the length of the movement of the board means between a cleaning and non-cleaning position. The housing sections includes a transverse raised ridge adjacent each elongated opening and particularly adjacent the recessed opening to form a stop for the planar board means in the cleaning position while a stop for the planar board means in the non-cleaning or retracted position is provided for in the difference in height between the raised rib sections and the short height section adjacent the transverse rib. The section also includes a pair of spaced apart guide notches adapted to receive therein raised ridges of the outside edges of the planar board means so as to act as a further guide for the slidable movement of the planar board means in said guide ridges between a cleaning and non-cleaning position.

The planar board means adopted has on one surface thereof a pair of spaced apart, raised guide ridges so designed and configures so as to be placed slidably adjacent the raised ribs in the housing section. The planar board also includes a raised transverse rib section, which transverse rib section moves against the raised rib in the housing in a cleaning position and moves against the wall of the raised, spaced apart parallel ribs in the housing section in a non-cleaning position so as to define the length of the movement between cleaning and non-cleaning positions within the housing. The planar board also contains a short, flat section having an abrasive material, typically on one surface, but more typically on both surfaces and on the edge, and generally by employment of placing a tape containing abrasive material on the flat surfaces and edge surfaces on this section of the planar board means. The other end of the planar board means generally extends out of the elongated slot within the housing and serves as a handle so that the operator may by grasping the handle move the board means slidably within the housing between the respective positions, so that in the cleaning operation, the operator after inserting the housing in the cartridge receptacle may push the planar board or the board means forward into a cleaning position and by backward and forward movement clean the electrical contacts. The cleaning cartridge of the invention may typically be employed in a cleaning-type kit which would include a cleaning cartridge together with one or more extra cleaning boards and replacement tips for the cleaning boards.

In the one preferred embodiment, the housing comprises two half sections, each substantially the same, which on being snap-fashioned together to form the housing about the cleaning board, form the guide notches upon respective raised ribs for the slidable movement of the cleaning board within the cartridge.

The invention will be described for the purposes of illustration only in connection with certain embodiments; however, it is recognized that various changes, modifications, additions and improvements may be made by those persons skilled in the art to the illustrated embodiments.

DESCRIPTION OF THE EMBODIMENTS

Figure 1:
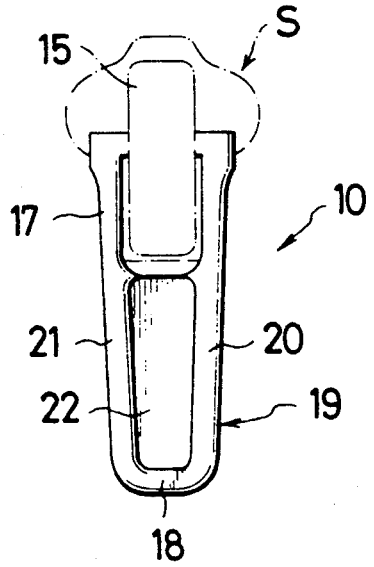
FIG. 1 shows perspective view from above of the cleaning cartridge of the invention in an open position without the cleaning board or wand.

With reference to the drawings, the cleaning device of the invention comprises a cartridge 50 and a planar board means 56. Cartridge bottom 52 and cartridge top 54 are releasably attached by hinges formed by hinge extensions 58 and hinge receptors 60 and by latch extension 62 and latch receptor 64. Both cartridge bottom 52 and cartridge top 54 have lateral walls 68 with vertical slides 70 that intersect perpendicularly with vertical insert stop 72 and have guide notches 74 for planar board guides 84. Cartridge 50 has recessed opening 77 on one side for engaging with the computer or video game. Vertical slides 70 have a lower height for a distance at the end adjoining vertical insert stop 72, or end prior to vertical insert stop 72, the difference in height forming slide stop 71.

Planar board means 56 is placed between cartridge bottom 52 and cartridge top 54. At one end is planar board handle 76 that projects beyond the rear of cartridge 50. Planar board guides 84 are guided by guide notches 74. On at least one side of planar board means 56 are a pair of parallel planar board ridges 78 which fit beside vertical slides 70. At the front end of planar board means 56 is a planar board stop 80 forward from which projects cleaning ridge 82 in the same plane as planar board means 56. Cleaning ridge 82 has cleaning material on its surface.

In operation, cartridge 50 is inserted into the computer or video game in the same manner as a program cartridge. Planar board means 56 is moved forward and backward by planar board handle 76. Forward movement is limited by the contact of planar board stop 80 with vertical insert stop 72. Backward movement is limited by the contact of planar board stop 80 with slide stop 71. Contact of planar board ridges 78 with the rear side wall of cartridge 50 between guide notches 74 also may limit backward movement.

More particularly, cartridge 50 consists of a cartridge bottom 52 and a cartridge top 54. The external dimensions of cartridge 50 are such as to permit cartridge 50 to be inserted into the computer or video game where the electrical contacts are to be cleaned. On a first side edge of cartridge bottom 52 there is at least one, and, preferably, more than one, hinge extension 58 and, on the opposing second side edge of cartridge bottom 52, at least one latch extension 62, hinge extension 58 and latch extension 62 projecting above the top surface of the side edges of cartridge bottom 52. On the corresponding first side edge of cartridge top 54 there are hinge receptors 60 that correspond to hinge extensions 58 and, at the opposing second side edge of cartridge top 54, latch snap in receptor 64 that corresponds to latch extension 62. When cartridge top 54 is matingly engaged to cartridge bottom 52 to form cartridge 50, hinge extensions 58 are matingly engaged in hinge receptors 60. Latch extension 62 then is snapped or pinched in place in latch receptor 64. If desired, cartridge bottom 52 and cartridge top 54 each may contain both extension and receptor elements with corresponding receptor and extension elements on the other cartridge section. Further, if desired, hinge extensions 58 and hinge receptors 60 can be replaced by a single integrated hinge means, such as a web of flexible plastic or other material, so that cartridge 50 is a single unit.

At least one of cartridge bottom 52 and one of cartridge top 54, and, preferably, both, include a series of ribs, ridges and guides in the interior of cartridge 50 raised from lateral wall 68. These include at least one, and, preferably, more than one, vertical slides 70 and at least one inset stop 72. These serve to guide planar board means 56 and also may provide structural support for cartridge 50.

Vertical slides 70 are perpendicular to the elongated, recessed opening 77. When there is more than one vertical slide 70, they generally are parallel to each other and are spaced so as to restrict lateral movement of planar board means 56, being parallel to planar board ridges 78 on planar board means 56. In particular, vertical slides 70 are parallel to each other, the width between each of vertical slides 70 being less than that between planar board ridges 78, that also are parallel, and are adjacent thereto, so that vertical slides 70 restrict lateral movement and serve to align planar board means 56. Alternatively, the width between vertical slides 70 may be greater than that between planar board ridges 78, so long as lateral movement of planar board means 56 is restricted. Vertical slides 70 include a section lower in height than the remainder of vertical slides 70 (or a section where there is no vertical slide), said section defining a short space to permit movement of planar board means 56 between cleaning and non-cleaning positions. The change in height in vertical slides 70 (or the end thereof) forms one or more slide stops 71. The length of planar board ridges 78 generally is equal to the length of the raised portion of vertical slides 70. Preferably, slide stop 71 is located toward the front side of cartridge 50.

Insert stop 72 is a transverse ridge, parallel to the front edge of cartridge 50. Inset stop 72 defines the interior edge of elongated opening 77 in the front edge of cartridge 50. If not previously terminated, vertical slides 70 terminate at their intersection with inset stop 72, preferably at a perpendicular angle.

Cartridge 50 includes on its front edge an elongated, recessed opening 77. Cartridge bottom 52 and cartridge top 54, include on their rear edges an opening for the rear section of planar board means 56. At the ends of said opening are guide notches 74 to guide planar board guides 84 of planar board means 56. In operation, the rear portion of planar board means 56 extends rearward of cartridge 50, fitting into an elongated slot between guide notches 74, said extension being adapted to serve as planar board handle 76.

Planar board means 56 includes a raised planar board stop 80, a transverse ridge, preferably toward the front of planar board means 56. Projecting from the front of planar board stop 80, generally in a flat manner on the same plane as the body of planar board means 56, is cleaning ridge 82. Cleaning ridge 82 is adapted to conform to the cartridge section of the computer or video game. Cleaning ridge 82 has cleaning material on at least one, but preferably both, sides and the edge thereof. Typically, this cleaning material is an abrasive substance. Such abrasive materials may be applied to cleaning ridge 82 by use of a tape containing the abrasive material, such as a nylon tape, which may be wrapped around cleaning ridge 82, covering both sides and the edge thereof. Use of such tape has the added advantage of being replaceable, so that when the tape becomes worn out, the tape can be replaced, rather than the entire planar board means 56 or the entire cartridge.

The cleaning cartridge is assembled by placing planar board means 56 in cartridge bottom 52 so that planar board ridges 78 are located beside vertical slides 70, planar board guides 84 are aligned in guide notches 74 with planar board handle 76 projecting out rearward of cartridge bottom 52 in an elongated slot between guide notches 74 and planar board stop 80 is placed parallel to and behind inset stop 72 and forward of slide stop 71. Cartridge top 54 then is placed on top of cartridge bottom 52 with planar board means 56 between said cartridge sections, and cartridge bottom 52 and cartridge top 54 are releasably fastened to each other, first by having hinge extensions 58 matingly engaged in hinge receptors 60, then by having latch extension 62 snapped or pinched into place in latch receptor 64.

Figure 5:
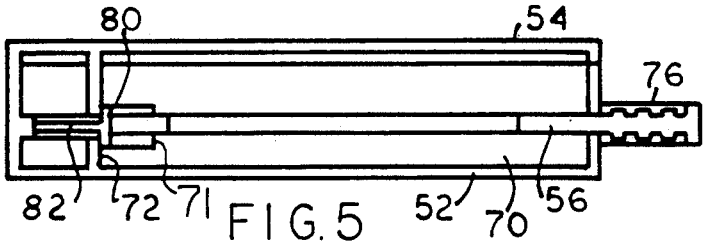
FIG. 5 is a sectional view along lines 5—5 of FIG. 3.
Figure 6:
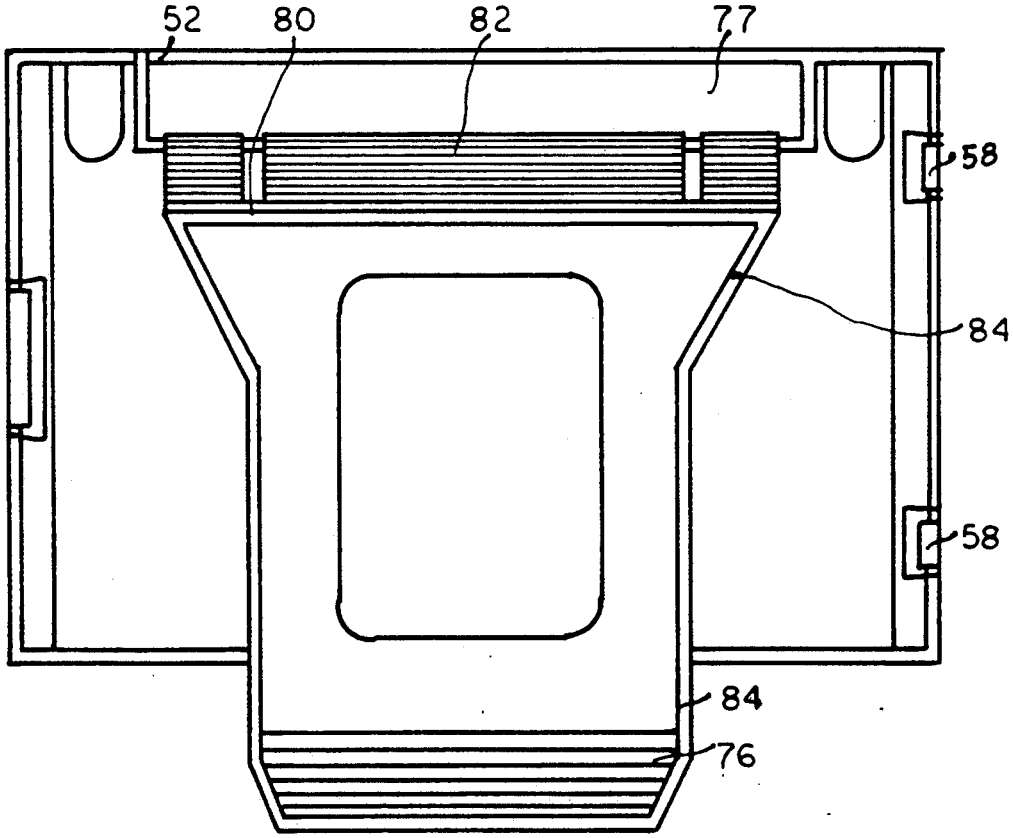
FIG. 6 a top plan view of the cleaning board of FIG. 2 in a non-cleaning position within the bottom half of the cartridge.
Figure 1:
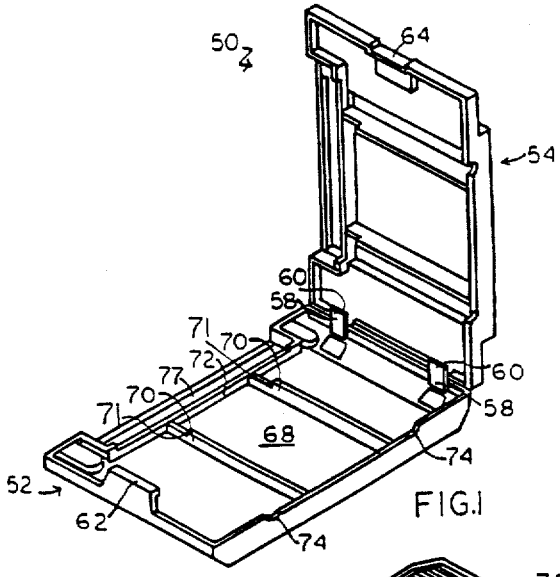
Figure 2:
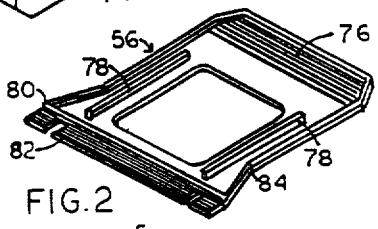
Figure 3:
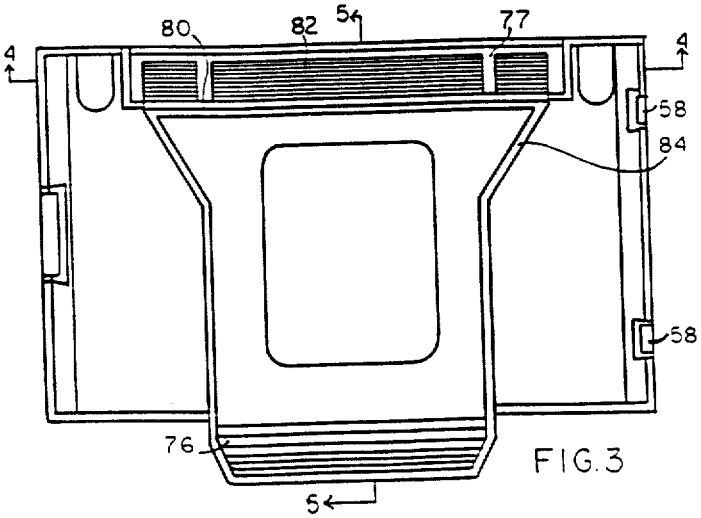

When assembled, planar board means 56 may be moved forward and backward, that is, forward to a cleaning position and backward to a non-cleaning position. When engaged into a cleaning position, planar board means 56 is pushed forward by means of planar board handle 76 until planar board stop 80 is in contact with inset stop 72. This position is shown in a top plan view in FIG. 3 and in a sectional view in FIG. 5. When withdrawn to a non-cleaning position, planar board means 56 is pulled backward by means of planar board handle 76 until planar board stop is in contact with slide stop 71. This position is shown in FIG. 6. In this position, planar board ridges 78 also may be in contact with the back wall of cartridge 50 to provide additional stop for planar board means 56.

In operation, cartridge 50 is placed in the computer or video game in the same manner as a conventional cartridge. This feature is well known and need not be described further. The side containing elongated opening 77 is inserted first. Cleaning of the electrical contacts in the computer is accomplished by movement of planar board means 56 so as to alternately place it in a cleaning, then a non-cleaning position. Planar board handle 76 is pushed to engage planar board means 56 in the cleaning position and pulled to retract planar board means 56 to the non-cleaning position. When engaged into the cleaning position, cleaning ridge 82 is placed adjacent to or in contact with the electrical contacts of the computer or video game. Movement of cleaning ridge 82 causes abrasion or friction to occur between it and the electrical contacts of the computer or video game, said abrasion or friction acting to clean said electrical contacts of dirt, dust, oil, oxidation and other debris. This abrasion or friction may be desirably enhanced by the addition of abrasives to cleaning ridge 82, preferably to both the top and bottom sides and the edge thereof. Abrasives can be added to cleaning ridge 82 by the use of abrasive nylon tape, folded around cleaning ridge 82 and running, for example, from planar board stop 80 on the top side of planar board means 56 to planar board stop 80 on the bottom side of planar board means 56. In use, cleaning of the electrical contacts is accomplished by the insertion of cartridge 50 in the computer or video game and one or more cycles of moving planar board means 56 from a non-cleaning position to a cleaning position and back to a non-cleaning position. Sequences of between six and twelve cycles have been found to be effective.

When, after use, cleaning ridge 82 has deteriorated, or itself has become contaminated with dust, dirt, oil and other debris, the cleaning ridge can be cleaned.

With the device of the invention removed from the computer or video game, and planar board means 56 engaged in the cleaning position, a wand, swab or brush may be used to clean cleaning ridge 82. Cleaning also may be accomplished by disassembling the cleaning device, removing planar board means 56 and using a wand, swab, brush or other cleaning means to clean cleaning ridge 82.

When cleaning ridge 82 has deteriorated from use, including when the abrasives have worn away, the cleaning device may be disassembled, planar board means 56 removed, a replacement planar board means put in its place and the cleaning device reassembled. It also is possible, where nylon tape or other similar material is used to add abrasives to cleaning ridge 82, to disassemble the device, remove planar board means 56, remove from cleaning ridge 82 the tape and replace it with new tape, and reassemble the device.

What is claimed is:

1. A cleaning cartridge device for cleaning electrical contacts within a computer video game receptacle, which device comprises:

a) a cartridge composed of one or more sections, said cartridge having an elongated opening on a first side for mounting within the computer video game receptacle adjacent to the electrical contacts therein;

b) means to secure releasably the cartridge together;

c) a removable planar board means, a portion of which is positioned within the cartridge, said planar board means capable of being slidably moved therein between a cleaning and non-cleaning position;

d) means to provide for the slidable movement of the planar board means between a cleaning and non-cleaning position which comprises generally spaced apart, parallel, raised ridges on the planar board means and adjacent vertical slides on an inside surface of the cartridge;

e) a cleaning surface at one end and a handle means at the other end of the planar board means, said handle means projecting rearward of said cartridge through an elongated slot on a second side of said cartridge opposite said first side; and f) stop means in the cartridge and on the planar board means to prevent the movement of the planar board means past the cleaning and non-cleaning positions, whereby the electrical contacts are cleaned by the movement of the cleaning surface when the planar board means is moved between the cleaning and non-cleaning positions.

2. The device of claim 1 wherein the said stop means includes a transverse ridge extending across the elongated opening.

3. The device of claim 1 having latch and hinge means to secure the two sections of the cartridge releasably together.

4. The device of claim 1 wherein the planar board means has ridges along its side edges, and the cartridge has guide notches on the side opposite the elongated opening of the cartridge for receiving said side ridges during the slidable movement of the planar board means between the cleaning and non-cleaning positions.

5. The device of claim 1 wherein the cleaning surface of the planar board means comprises a tape means with abrasive materials thereon.

6. The device of claim 1 wherein the planar board means has one or more raised ridges, perpendicular to the cleaning surface and said ridges, when located in the cartridge, are adjacent to parallel spaced guide rails, perpendicular to said first side and extending generally from the side of the cartridge opposite said first side toward said first side, whereby said guide rails restrict lateral movement of the planar board means.

7. The device of claim 2 wherein the stop means further includes a guide stop means formed by a notch in one or more spaced guide rails in the cartridge, whereby movement of the planar board means is stopped in the non-cleaning position by the contact of the planar board ridge with a guide stop means.

8. The device of claim 7 wherein the planar ridge is a transverse ridge, and wherein the cartridge has a pair of parallel guide rails.

9. The device of claim 1 wherein the planar board means can be removed and replaced by releasing the means securing the cartridge, removing the planar board means, placing another planar board means in its place and then resecuring said cartridge.

10. In combination, a computer video game having a game cartridge receptacle with electrical contacts therein, and the device of claim 1 inserted in the cartridge receptacle for cleaning of the electrical contacts.

* * * * *

UNITED STATES PATENT AND TRADEMARK OFFICE

CERTIFICATE OF CORRECTION

PATENT NO. : 5,187,902

DATED : February 23, 1993

INVENTOR(S) : Louis J. Bakanowsky, III

It is certified that error appears in the above-identified patent and that said Letters Patent is hereby corrected as shown below:

The title page should be deleted to be replaced with the attached title page.

Figure 2:
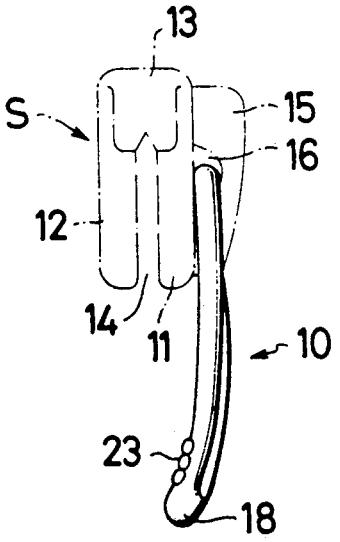
FIG. 2 is a perspective view from above of a cleaning board or wand in the cleaning cartridge of FIG. 1.
Figure 3:
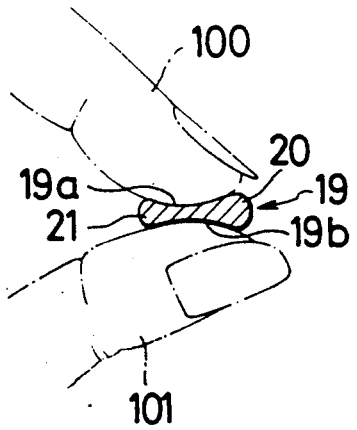
FIG. 3 is a top plan view of the cleaning board or wand of FIG. 2 in a cleaning position within the bottom half of the cartridge of FIG. 1.
Figure 4:
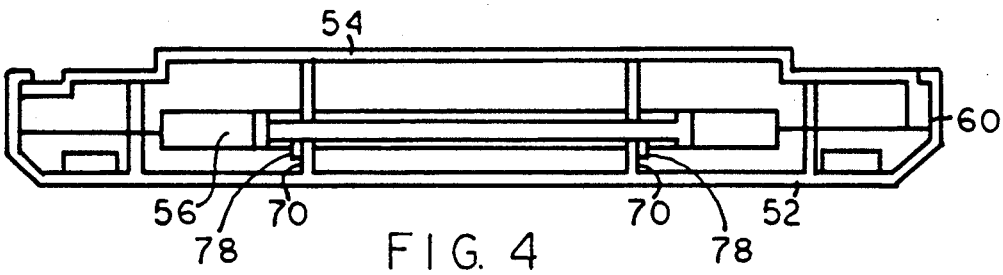
FIG. 4 is a section view along lines 4—4 of FIG. 3.

The drawing sheet consisting of Figs. 1, 2 and 3 should be deleted to be replaced with the drawing sheets consisting of Figs.1-3, as shown on the attached page.

Signed and Sealed this

Eighth Day of June, 1993

*Attest:*

Michael K. Kirk

MICHAEL K. KIRK

*Attesting Officer*

*Acting Commissioner of Patents and Trademarks*

United States Patent [19]

Bakanowsky, III

[11] Patent Number: 5,187,902

[45] Date of Patent: *Feb. 23, 1993

[54] CLEANING CARTRIDGE FOR COMPUTER AND VIDEO GAMES

[75] Inventor: Louis J. Bakanowsky, III, Fitchburg, Mass.

[73] Assignee: Curtis Manufacturing Company, Inc., Jaffrey, N.H.

[ * ] Notice: The portion of the term of this patent subsequent to Sept. 8, 2008, has been disclaimed.

[21] Appl. No.: 900,417

[22] Filed: Jun. 18, 1992

Related U.S. Application Data

[63] Continuation-in-part of Ser. No. 721,163, Jun. 26, 1991, Pat. No. 5,144,775.

[51] Int. Cl.[5] ..... B24B 29/06

[52] U.S. Cl. ..... 51/205 R; 15/210 R; 51/205 WG

[58] Field of Search ..... 51/57, 281 R, 59 R, 51/358, 381, 392, 393, 205 R, 205 WG; 15/104.92, 104.93, 104.94, 210 R, 118; 134/6, 8, 22.1

[56] References Cited

U.S. PATENT DOCUMENTS

| | | | |
|---|---|---|---|
| 3,807,010 | 4/1974 | Semrad | 15/210 R |
| 3,956,789 | 5/1976 | Shultz | 51/59 R |
| 4,428,092 | 1/1984 | Lipari | 15/246 |
| 4,951,425 | 8/1990 | Naghi | 15/210 R |
| 4,993,100 | 2/1991 | Halboth | 15/210 R |
| 5,025,526 | 6/1991 | Ichitsubo | 15/210 R |

*Primary Examiner*—Bruce M. Kisliuk
*Assistant Examiner*—Jack Lavinder
*Attorney, Agent, or Firm*—Richard P. Crowley

[57] ABSTRACT

A cleaning cartridge device for cleaning the electrical contacts within a computer video game receptacle. The device includes a housing for insertion into the cartridge receptacle, a board 56 with cleaning material at the one end within the housing, the board having a handle end 76 extending from one end of the housing, and the board slidably movable by the use of the handle end 76 between defined stop positions of a cleaning position for the electrical contacts with the cleaning material in contact with the electrical contacts and a non-cleaning position spaced apart from the electrical contacts.

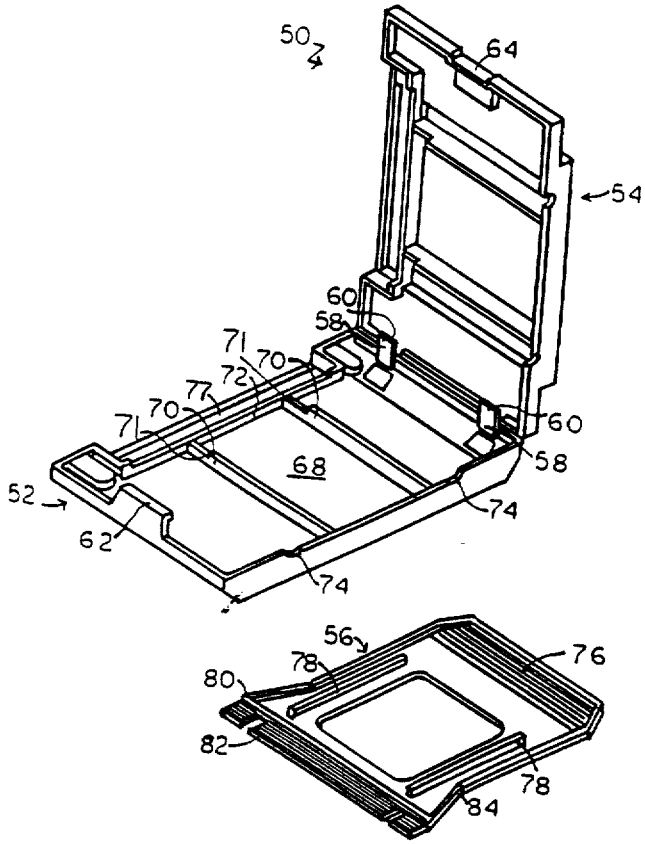

10 Claims, 2 Drawing Sheets